United States Patent [19]

Ehlen

[11] 4,120,277

[45] Oct. 17, 1978

[54] BREAKERLESS MAGNETO DEVICE

[75] Inventor: Jack W. Ehlen, Torrance, Calif.

[73] Assignee: McCulloch Corporation, Los Angeles, Calif.

[21] Appl. No.: 790,704

[22] Filed: Apr. 25, 1977

[51] Int. Cl.[2] ..... F02P 1/00

[52] U.S. Cl. ..... 123/148 CC; 123/117 R; 123/148 DS; 123/149 D; 123/148 E; 315/209 CD

[58] Field of Search ..... 123/148 CC, 148 DS, 123/148 AC, 148 R, 149 A, 149 D, 149 FA, 148 DR, 148 F, 148 E; 315/209 CD, 218; 310/153, 10, 208

[56] References Cited

U.S. PATENT DOCUMENTS

| | | | |
|---|---|---|---|
| 2,924,633 | 2/1960 | Sichline et al. | 315/209 CD |
| 3,229,162 | 12/1960 | Louden | 315/209 CD |
| 3,311,783 | 3/1967 | Gibbs et al. | 315/209 CD |
| 3,358,665 | 12/1967 | Carmichael | 315/209 CD |
| 3,598,098 | 5/1969 | Sohner | 123/148 CC |
| 3,667,441 | 6/1972 | Cavil | 123/148 CC |
| 3,732,483 | 5/1973 | Katsumata | 123/149 R |
| 3,894,524 | 7/1975 | Burkett et al. | 315/209 CD |
| 3,938,491 | 2/1976 | Mazza | 123/149 D |
| 3,948,239 | 4/1976 | Katsumata | 123/149 D |
| 4,056,088 | 11/1977 | Carmichael | 123/148 E |

FOREIGN PATENT DOCUMENTS

| | | | |
|---|---|---|---|
| 1,166,290 | 6/1958 | France | 315/209 CD |
| 1,325,736 | 3/1962 | France | 315/209 CD |

*Primary Examiner*—Charles J. Myhre
*Assistant Examiner*—R. A. Nelli
*Attorney, Agent, or Firm*—Finnegan, Henderson, Farabow & Garrett

[57] ABSTRACT

The embodiments of the breakerless magneto device disclosed herein have a rotor with a permanent magnet imbedded in the periphery thereof which acts in cooperation with the first and second magneto cores to generate a varying flux field in the cores. The first core has a first winding mounted thereon and the second core, which is mounted next adjacent the first core but insulated therefrom, has a second winding mounted thereon. The first winding therefore encompasses the first core, the second core, and the second winding. The second winding provides a trigger pulse to a solid state device which interrupts the current in the first winding, at or near its maximum value, thereby collapsing the flux field in the first core. This causes a high voltage to be induced in the secondary winding of the magneto coil which is applied to the spark gap for fuel ignition. Stable and proper spark timing is achieved with this device.

13 Claims, 4 Drawing Figures

BREAKERLESS MAGNETO DEVICE

BACKGROUND OF THE INVENTION

Magneto ignition systems are based upon the electrical principle that voltage is generated in any conductor which is subjected to a change in magneto flux through the conductor. More specifically, a sudden collapsing of the magnetic flux in the core upon which a conductor is mounted will induce a high voltage which can be applied to a spark gap for fuel ignition.

The conventional ignition systems for internal combustion engines have used cam actuated breaker points. The breaker points physically break the magneto coil circuit to induce a high voltage at the proper time in the engine cycle to cause sparking action at the spark plug. With the advent of solid-state switching circuits, many designers in the ignition art recognized the advantages of substituting such circuits for the breaker points. Various electronic circuits, including transistors and silicon controlled rectifiers (SCR), were used in place of the breaker points to interrupt the current to the magneto or primary winding. The use of an auxiliary pick off coil to trigger the switching action of the electronic circuit also was implemented as an appropriate means to control the timing of the switching action.

The first step in the evolution of breakerless magneto ignition systems was to connect a semiconductor device to the primary winding of the magneto coil and rely upon the coil to carry out its basic function of supplying a high voltage to the spark plug and also to provide the additional function which had formerly been performed by the breaker points.

When the magneto coil was used to provide both functions, a design tradeoff was necessary. If the solid-state device was performing its functions perfectly, i.e., allowing no voltage to develop across the primary terminals, then there would be no voltage signal present from which a spark timing signal could be derived. If a voltage were allowed to develop across the primary (which in the practical solid-state situation always occurs) then the efficiency and effectiveness of the spark system was drastically reduced. In either case, a problem would exist in that the ideal instant to interrupt the primary circuit, thereby collapsing the flux field and inducing a high voltage in the secondary circuit, is at the moment of maximum primary current. Any scheme combining the circuit interrupting function and the timing function on a single coil winding thereby necessitated a design compromise.

One solution to the problem was the introduction of a separate trigger winding mounted with the magneto coil on a single magnetic core. With a separate winding on the same core there was no longer unity coupling between the primary winding and the trigger winding. With this construction a portion of the voltage induced in the added winding was generated by magnetic flux that did not contribute to the current flow in the short circuited primary. It is clear that if the coupling between the two windings, the primary winding and the trigger winding, were complete, the additional winding would produce no different results than what had previously been obtained by using the primary winding for both functions.

But even with a separate trigger winding mounted on the same core, the performance of these magneto ignition systems was not satisfactory. Often the resulting spark was erratic and unstable in both amplitude and time.

The present invention overcomes these defects and produces a better, more stable ignition system. The primary and trigger windings are mounted on separate, cores. The core upon which the auxiliary trigger coil is mounted is necessarily located close to and adjacent the main magnetic core of the magneto for reasons of spark timing and is operationally substantially isolated magnetically. By adjusting the spacing between the auxiliary trigger core and the main core, the instant of spark occurrence with respect to maximum primary current can be independently controlled. Spark timing with respect to piston position (or crank angle) is controlled by angular orientation of the entire magneto assembly.

SUMMARY OF THE INVENTION

The present invention overcomes the problems of the prior art by providing a magneto ignition system comprised of a first magneto core having a first winding mounted thereon, a second core next adjacent the first core and positioned inside the first winding, the second core having a trigger winding mounted thereon, and a rotor structure having a permanent magnet which produces a varying flux field in the first and second cores. The second core, although mounted closely to the first core, is operationally substantially isolated magnetically from the first core. A primary circuit is provided for current build-up in the primary winding. The voltage pulse generated in the second winding due to the varying flux field of the rotating permanent magnet is applied to a solid-state device such as an SCR which interrupts the current in the primary circuit, at or near its maximum, thereby collapsing the flux field. A high voltage is induced in the secondary winding of the magneto coil and is applied to the spark gap for fuel ignition.

DESCRIPTION OF THE PREFERRED EMBODIMENTS

Reference will now be made in detail to the preferred embodiments of the invention, examples of which are illustrated in the accompanying drawings.

Figure 1:
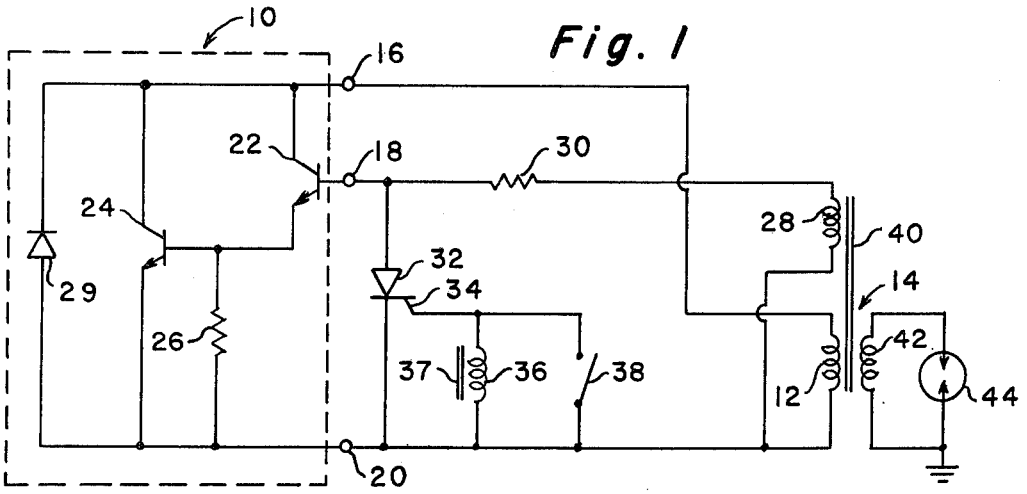
FIG. 1 is a circuit diagram of a preferred embodiment of the present invention.

Referring to FIG. 1, there is shown a circuit diagram for the breakerless ignition system of this invention. In accordance with the invention, a semiconductor device 10 is connected across the terminals of the primary winding 12 of the magneto coil 14. Preferably the semiconductor device 10 has first, second and third output terminals 16, 18 and 20 respectively which for instance can be the collector, base and emitter of the device 10.

It is preferred that the semiconductor device 10 include first and second transistors, 22 and 24 respectively, connected in a Darlington arrangement. The collector and base of the first transistor 22 serve as the first and second terminals 16 and 18 respectively of the semiconductor device 10. The emitter of the first transistor 22 is connected to the base of the second transistor 24 and to one end of resistance 26. The other end of resistance 26 is connected to the emitter of the second transistor 24 which also serves as the third terminal 20 of the semiconductor device 10.

Preferably the semiconductor device 10 further includes a diode 29 connected across the collector and emitter of the second transistor 24. Diode 29 serves to bypass the reverse direction current which is generated in the primary winding 12.

As herein embodied, terminal 18 is connected to one side of power supply winding 28 through resistance 30. The other side of the power supply winding 28 is connected to terminal 20.

According to the invention, means responsive to a voltage to switch from a conductive to a nonconductive state is connected across terminals 18 and 20 of semiconductor device 10. As herein embodied, the means is a silicon controlled rectifier (SCR) 32. The silicon controlled rectifier 32 has a gate 34 connected to one end of trigger coil 36 which is mounted on core 37. The other end of the trigger coil 36 is connected to terminal 20. A kill switch 38 is connected across trigger coil 36 and is operative to short circuit coil 36 thereby turning off the breakerless ignition system as is discussed below.

As herein embodied, a first core 40 is provided on which a first winding, the primary winding 12, is mounted. The power supply coil 28 is also mounted on the core 40. Preferably means is provided for completing a circuit through the first winding 12 which can include the semiconductor device 10 with terminals 16 and 20 respectively connected to the ends of the first winding 12.

Engine fuel ignition means, here embodied as spark plug 44, is connected across the magneto coil 14 and more specifically, as shown in FIG. 1, across the secondary winding 42. The current generated in the first winding, primary winding 12, produces a magnetic field affecting the common core 40 of the primary and secondary winding which induces a voltage in the secondary winding 42 which is applied to spark plug 44.

It will be appreciated that distributor means can be provided where a multiple cylinder internal combustion engine is used. The voltage produced in the primary winding 12 can then selectively be applied to each spark plug corresponding to the respective cylinders.

Figure 2:
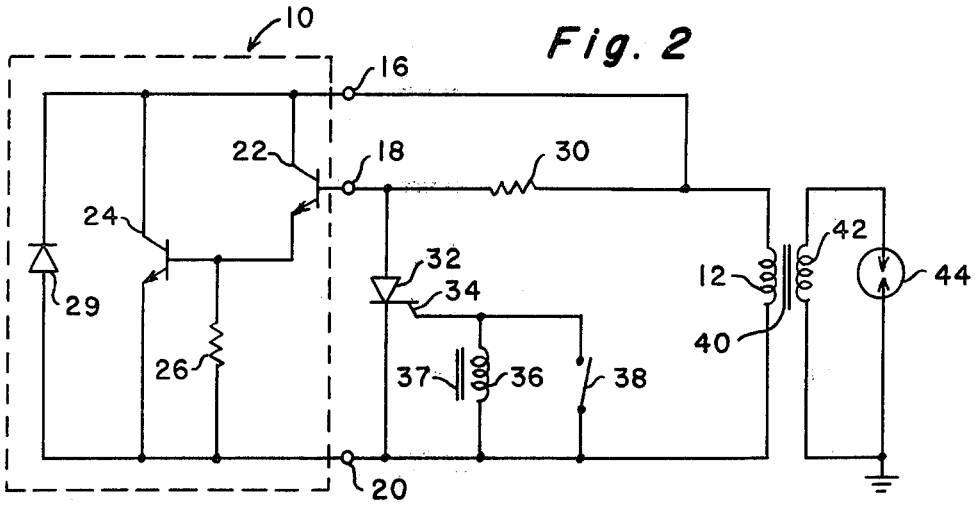
FIG. 2 is a circuit diagram of another preferred embodiment of the present invention.

A second preferred embodiment of the breakerless ignition system of the present invention is depicted in FIG. 2. Like elements of the circuit as shown in FIG. 1 have been identified by the same symbols. In FIG. 2 the circuit has been modified to eliminate the power supply winding 28 and to incorporate its function in the primary winding 12 of the magneto coil 14. By so doing one winding can be eliminated thereby simplifying the construction of the breakerless ignition system and improving the efficiency of the primary winding. However, the efficiency of the semiconductor device 10 would be somewhat impaired when the bias from the power supply winding is not present.

Figure 3:
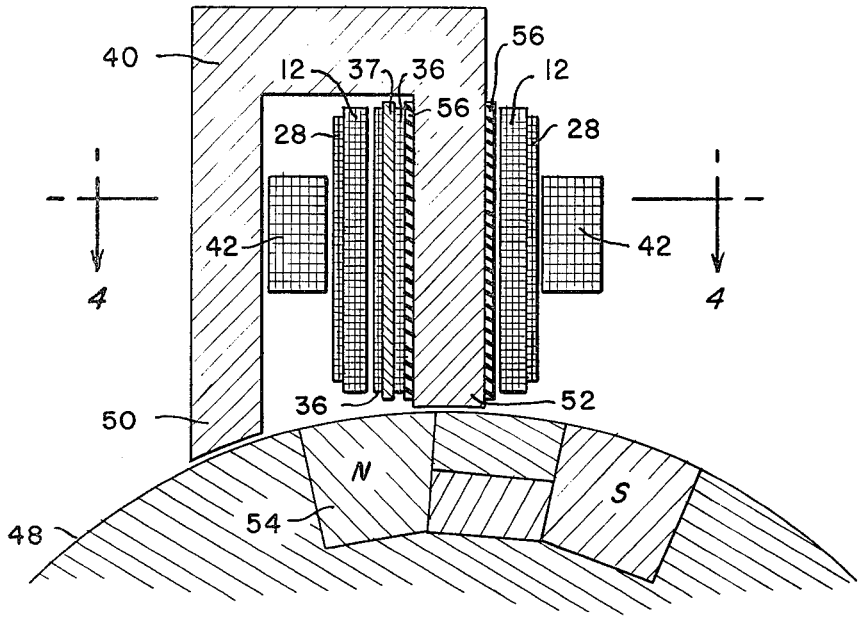
FIG. 3 is a cross-sectional representation of the core and coil structures of the present invention.
Figure 4:
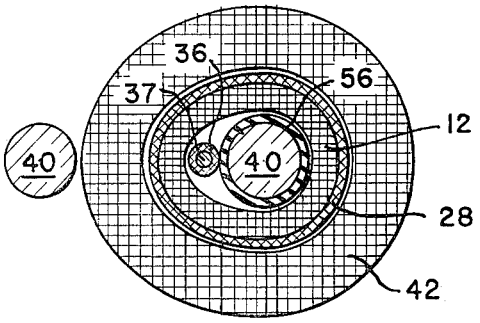
FIG. 4 is a sectional view of FIG. 3, highlighting the trigger coil placement and winding structures.

The construction of the magneto and trigger cores and their respective windings is shown in FIG. 3. As herein embodied a first core 40 has a general inverted U-shape and is positioned adjacent the rotor 48. More specifically the first core 40 preferably has a leading leg portion 52 and a trailing leg portion 50. The respective ends of the leg portions 50 and 52 are positioned so that a small air gap is maintained between the rotor and the core.

As herein embodied the rotor 48 of a non-magnetic material has a permanent magnet 54 embedded in its periphery for providing a rotating field or source of flux for the magneto system. It will be appreciated that variations can be made in the configuration of the magnet and rotor without varying from the concept taught in this invention.

The rotor 48 is usually cast directly on the shaft from the internal combustion engine and, as here shown, rotates in a counterclockwise direction in synchronism with the engine. The air gap between the first core 40 and the rotor 48 is minimized so that the total reluctance of the magnetic circuit when the poles of the magnet are aligned respectively with the legs of the core is small. When the poles of the magnet are aligned with the end portions of the legs 50 and 52 most of the flux from the rotating field member passes through the first core 40.

Preferably and as herein embodied, a second core 37 having a trigger winding 36 mounted thereon is positioned next adjacent and spaced from the first core 40. This can be achieved by placement of an insulating spacer 56 between the trigger winding 36 and core 40.

It has been found to be preferable that the second core and the trigger winding mounted thereon be positioned adjacent to the leg 52 of core 40 as shown in FIG. 3.

As herein embodied the first winding, primary winding 12, is mounted on leg 52 of core 40 to encompass both the second core 37 and the second winding 36. Preferably the second core is positioned parallel to and next adjacent leg 52.

If a separate power supply winding 28 is provided it is preferably mounted on the primary winding 12 as shown in FIG. 3. The windings and core structures required to implement the embodiment of FIG. 2 is the same as shown in FIG. 3 except that winding 28 is not required. The secondary winding 42 is mounted on the power supply winding 28 as shown in FIG. 3. Each of the respective windings, primary winding 12, power supply winding 28 and secondary winding 42 are mounted concentric with the leg 52 of the core 40. It will be appreciated, although not shown, that insulating spacers can be used to position the respective windings in a proper relationship to one another and to the core 40.

The breakerless ignition system of the present invention has been used with the internal combustion engine of a chain saw. The following table shows values for the respective windings for such an application:

| Winding | No. of Turns | Size of Wire |
|---|---|---|
| Primary | 85 | 21 |
| Secondary | 8000 | 44 |
| Power Supply | 100 | 35 |
| Trigger | 200 | 35 |

The breakerless ignition system of the present invention operates as follows: As rotor 48 turns, bringing the magnet poles N and S of permanent magnet 54, into alignment with the first core 40, a voltage is generated in the primary winding 12 and in the power supply winding 28. The voltage in the power supply winding 28 creates a current flow through resistance 30 to the base of the first transistor 22. Transistor 22 is turned on which in turn turns on the second transistor 24.

When the second transistor 24 is turned on, a circuit through the first winding, primary winding 12, is completed. There occurs a current build up in the primary winding 12 and energy is stored in the magnetic field of the first core 40.

The second core 37 and trigger winding 36 are positioned inside and adjacent the first leg 52 so that a voltage pulse is generated in the trigger winding at the time that the current in the primary winding 12 is substantially at its maximum value. The trigger voltage pulse is applied to the gate terminal 34 of the silicon controlled rectifier 32 placing it in a conductive state. The flow of current to the primary winding 12 is thereby interrupted.

When the current passes through the silicon controlled rectifier 32, the base drive of the first transistor 22 is removed and in turn the base drive for the second transistor 24 is also removed turning it off. The magnetic field, which at this point has built to a maximum point, collapses very rapidly and induces a high voltage in the secondary winding 42. This voltage is clamped by the spark plug 44 firing or when the primary voltage reaches the breakdown voltage of transistor 24. Typically the windings are so designed to allow an output voltage of at least 15,000 volts before the breakdown voltage of transistor 24 is reached. This cycle repeats itself for each firing of the spark plug.

What is claimed is:

1. A magneto ignition system for use with an internal combustion engine, comprising:

a first core, a first winding mounted on said first core, means for completing a circuit through said first winding, a second core positioned inside said first winding next adjacent and spaced from said first core, a trigger winding mounted on said second core, a rotor having a permanent magnet for producing varying flux through said first and second cores to induce voltages across the respective first winding and trigger winding, and means responsive to the voltage generated in said trigger winding for selectively interrupting the flow of current through said circuit means.

2. The magneto ignition system of claim 1 further comprising:

engine fuel ignition means for igniting combustible fuel in said engine, and means for applying the voltage from said first winding to said engine fuel ignition means.

3. The magneto ignition system of claim 1 wherein said second core is next adjacent and parallel to a portion of said first core.

4. The magneto ignition system of claim 3 wherein said means for completing a circuit through said first winding includes a semiconductor device connected across said first winding.

5. The magneto ignition system of claim 4 wherein said semiconductor device is a first and second transistor connected in a Darlington arrangement and the collector and emitter of said Darlington arrangement are connected to respective ends of said first winding.

6. The magneto ignition system of claim 4 wherein said means responsive to the voltage generated in said trigger winding includes a controlled rectifier connected in parallel with said semiconductor device and said first winding, said controlled rectifier having a gate electrode connected to said trigger winding.

7. The magneto ignition system of claim 1 wherein said first core is U-shaped having a first and a second leg, said second core having said second winding mounted thereon is positioned parallel to and next adjacent said first leg, and said first winding is mounted on said first leg to encompass said second core and said second winding.

8. The magneto ignition system of claim 1 further including a power supply winding mounted on said first core and connected to said means for completing a circuit through said first winding.

9. A magneto ignition system for use with an internal combustion engine comprising:

means including at least two magnetic circuits for a varying flux field having a single rotor and first and second cores respectively with a first winding mounted on said first core for generating a voltage potential and a second winding mounted on said second core for generating a trigger signal, said second core and said second winding being positioned next adjacent and parallel to a portion of said first core and inside said first winding, engine fuel igniting means for igniting combustible fuel in said engine, and means for selectively causing said voltage potential generated in said first winding to be applied to said igniting means, said means being connected to said second winding and responsive to the trigger signal for causing said voltage potential to be applied to said igniting means.

10. The magneto ignition system of claim 9 wherein said last mentioned means includes a semiconductor device connected across said first winding, a controlled rectifier connected in parallel with said semiconductor device and said first winding, said controlled rectifier having a gate electrode connected to said second winding and responsive to said trigger signal to make said rectifier conductive.

11. The magneto ignition system of claim 10 wherein said semiconductor device is a first and second transistor connected in a Darlington arrangement.

12. The magneto ignition system of claim 9 further including a power supply winding mounted on said first winding and around said first core for supplying power to said last mentioned means.

13. A magneto ignition system comprising:

a core structure including a first core having a magneto coil mounted thereon and a trigger core positioned inside said magneto coil next adjacent said first core and having a trigger winding mounted thereon, said trigger core and winding being spaced from said first core, a rotor structure having a permanent magnet thereon, said rotor producing a varying flux through said first and second cores, means for completing a circuit through said magneto coil, and means responsive to the voltage generated in said trigger winding by said varying flux for interrupting the flow of current through said circuit.

* * * * *